US005556573A

United States Patent [19]

Weuthen et al.

[11] Patent Number: 5,556,573

[45] Date of Patent: Sep. 17, 1996

[54] PROCESS FOR THE PRODUCTION OF STORABLE NONIONIC SURFACTANTS

[75] Inventors: Manfred Weuthen, Solingen; Thomas Engels, Frechen; Herman Hensen, Haan; Holger Tesmann, Juechen; Dieter Nickel, Erkrath, all of Germany

[73] Assignee: Henkel Kommanditgesellschaft auf Aktien, Duesseldorf, Germany

[21] Appl. No.: 374,687

[22] PCT Filed: Jul. 21, 1993

[86] PCT No.: PCT/EP93/01939

§ 371 Date: Jan. 26, 1995

§ 102(e) Date: Jan. 26, 1995

[87] PCT Pub. No.: WO94/03569

PCT Pub. Date: Feb. 17, 1994

[30] Foreign Application Priority Data

Jul. 30, 1992 [DE] Germany ..... 42 25 224.5

[51] Int. Cl.[6] ..... C11D 1/66; C11D 3/02; C11D 7/02

[52] U.S. Cl. ..... 510/535; 510/470; 510/508; 510/405; 252/351; 252/352

[58] Field of Search ..... 252/174.17, 174.18, 252/174.19, 174.21, 174.22, 173, DIG. 1, DIG. 14

[56] References Cited

U.S. PATENT DOCUMENTS

| | | | |
|---|---|---|---|
| H171 | 12/1986 | McDaniel et al. | 252/174.17 |
| 2,596,093 | 5/1952 | de Benneville | 252/DIG. 1 |
| 2,601,329 | 6/1952 | Sanders et al. | 252/DIG. 1 |
| 2,888,489 | 5/1959 | Horsley et al. | 252/174.21 |
| 3,382,285 | 5/1968 | Egan et al. | 252/DIG. 1 |
| 3,865,754 | 2/1975 | Norris et al. | 252/174.17 |
| 5,169,553 | 12/1992 | Durbut et al. | 252/99 |
| 5,230,835 | 7/1993 | Deguchi et al. | 252/550 |
| 5,318,715 | 6/1994 | Krishnan | 252/99 |
| 5,370,816 | 12/1994 | Balzer et al. | 252/174.21 |

FOREIGN PATENT DOCUMENTS

| | | | |
|---|---|---|---|
| 0136844 | 4/1985 | European Pat. Off. | C11D 3/22 |
| 0301298 | 2/1989 | European Pat. Off. | C07H 15/04 |
| 0377807 | 7/1990 | European Pat. Off. | C11D 1/66 |
| 0388810 | 9/1990 | European Pat. Off. . | |
| 0405967 | 1/1991 | European Pat. Off. | C11D 1/825 |
| 0408965 | 1/1991 | European Pat. Off. | C11D 1/825 |
| 0444262 | 9/1991 | European Pat. Off. | C11D 1/66 |
| 0487262 | 5/1992 | European Pat. Off. | C11D 1/825 |
| 1284456 | 8/1972 | United Kingdom | C11D 1/66 |
| 8604349 | 7/1986 | WIPO | C11D 1/72 |
| 9003977 | 4/1990 | WIPO | C07H 15/04 |

*Primary Examiner*—Asok Pal
*Assistant Examiner*—Patricia L. Hailey
*Attorney, Agent, or Firm*—Wayne C. Jaeschke; John E. Drach; Henry E. Millson, Jr.

[57] ABSTRACT

Process for the production of aqueous storable nonionic surfactants in which crystallization moderators selected from the group consisting of a) alkyl glycosides based on short-chain primary alcohols,
b) alkyl glycosides based on Guerget alcohols,
c) glycosides based on polyols,
d) short-chain primary alcohols,
e) fatty alcohol polyglycol ethers,
f) polyethylene glycols,
g) glucose and
h) iron(III) ions are added to aqueous preparations containing alkyl and/or alkenyl glycosides corresponding to formula (I):

$$R^1O-(G)_p \quad (I)$$

in which $R^1$ is a linear alkyl and/or alkenyl radical containing 6 to 22 carbon atoms, G is a sugar unit containing 5 or 6 carbon atoms and p is a number from 1 to 10.

3 Claims, No Drawings

PROCESS FOR THE PRODUCTION OF STORABLE NONIONIC SURFACTANTS

BACKGROUND OF THE INVENTION

1. Field of the Invention

This invention relates to a process for the production of storable nonionic surfactants with improved resistance to crystallization, in which selected crystallization moderators are added to alk(en)yl oligoglycosides.

2. Statement of Related Art

Alk(en)yl oligoglycosides are important nonionic surfactants which are being used to an increasing extent in laundry detergents, dishwashing detergents and cleaning products by virtue of their favorable detergent properties and their high ecological compatibility.

For this purpose, alk(en)yl oligoglycosides have to be kept available and stored, for example as aqueous solutions or pastes, for certain periods pending final processing. However, since aqueous alk(en)yl oligoglycosides have a pronounced tendency towards crystallization, the homogeneity of such preparations gradually decreases during storage under ambient conditions, resulting in the formation of agglomerates containing water of crystallization which reduce the pumpability of the products to a considerable extent.

Accordingly, alk(en)yl oligoglycosides are not normally stored at room temperature, but at temperatures of at least 40° C. Although the preparations can largely be prevented from crystallizing in this way, storage at elevated temperatures involves additional costs and, moreover, can seriously affect the color quality of the products.

Accordingly, the problem addressed by the present invention was to provide a process by which alk(en)yl oligoglycosides could be stored at temperatures below 40° C. without the pumpability of the products being impaired by the formation of crystalline agglomerates.

DESCRIPTION OF THE INVENTION

The present invention relates to a process for the production of storable nonionic surfactants, in which crystallization moderators selected from the group consisting of a) alkyl oligoglycosides based on short-chain primary alcohols,
b) alkyl oligoglycosides based on Guerbet alcohols,
c) alkyl oligoglycosides based on polyols,
d) short-chain primary alcohols,
e) fatty alcohol polyglycol ethers,
f) polyethylene glycols,
g) glucose and
h) iron(III) ions are added to aqueous preparations containing alkyl and/or alkenyl oligoglycosides corresponding to formula (I):

$$R^1O—(G)_p \quad (I)$$

in which $R^1$ is a linear alkyl and/or alkenyl radical containing 6 to 22 carbon atoms, G is a sugar unit containing 5 or 6 carbon atoms and p is a number of 1 to 10.

It has surprisingly been found that the tendency of the alk(en)yl oligoglucosides towards crystallization can be greatly reduced by adding small quantities of selected moderators to them. Aqueous preparations which remain stable in storage and color-stable for months at temperatures around 30° C. and which have hardly any tendency towards crystallization are obtained in this way.

Alkyl and alkenyl oligoglycosides are known substances which may be obtained by the relevant methods of preparative organic chemistry. EP-A1-0 301 298 and WO 90/3977 are cited as representative of the extensive literature available on this subject.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides.

The index p in general formula (I) indicates the degree of oligomerization (DP degree), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view.

The alkyl or alkenyl radical $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxo synthesis. Alkyl oligoglucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred.

In addition, the alkyl or alkenyl radical $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and technical mixtures thereof which may be obtained as described above. Alkyl oligoglucosides based on hydrogenated $C_{12/14}$ coconut oil fatty alcohol having a DP of 1 to 3 are preferred.

Suitable crystallization moderators are compounds belonging to the following classes:

a) Alkyl oligoglycosides based on short-chain primary alcohols. These include methyl and butyl glucosides.

b) Alkyl oligoglycosides based on Guerbet alcohols. These include alkyl oligoglycosides which are obtained by acid-catalyzed acetalization of glycoses, more particularly glucose, with Guerbet alcohols and which correspond to formula (II):

$$R^2O—(G)_p \quad (II)$$

in which $R^2$ is a branched alkyl radical containing 12 to 32 carbon atoms and G and p are as defined above. Typical examples are alkyl oligoglucosides with a DP degree of 1.3 to 1.6 based on 2-ethylhexanol or 2-hexyldecanol.

c) Alkyl oligoglycosides based on polyols. These include alkyl oligoglycosides which are obtained by acid-catalyzed acetalization of glycoses, more particularly glucose, with polyols and which correspond to formula (III):

$$HO—(CH_2CH_2O)_n—(G)_p \quad (III)$$

in which n is a number of 1 to 10 and G and p are as defined above. Typical examples are alkyl oligoglucosides with a DP degree of 1.3 to 1.6 based on ethylene glycol, diethylene glycol or triethylene glycol.

d) Short-chain primary alcohols corresponding to formula (IV):

$$R^3OH \quad (IV)$$

in which $R^3$ is a linear alkyl radical containing 4 to 14 carbon atoms. Typical examples are butanol, pentanol, caproic alcohol, caprylic alcohol, capric alcohol, lauryl alcohol and myristyl alcohol.

e) Fatty alcohol polyglycol ethers corresponding to formula (V):

$$R^4O—(CH_2CH_2O)_nH \quad (V)$$

in which $R^4$ is a linear alkyl and/or alkenyl radical containing 8 to 22 carbon atoms and n is a number of 1 to 10. Typical examples are adducts of, on average, 5 to 7 moles of ethylene oxide with technical $C_{12/14}$ cocofatty alcohol.

f) Polyethylene glycols corresponding to formula (VI):

$$HO—(CH_2CH_2O)_mH \quad (VI)$$

in which m is a number of 5 to 20. Typical examples are polyethylene glycols with an average molecular weight of 300 to 600.

g) Glucose;

h) Iron(III) ions which may be added, for example, in the form of iron(III) salts, such as $FeCl_3$ for example.

The crystallization moderators may be added to the alkyl and/or alkenyl oligoglycosides in quantities of 0.01 to 7% by weight and preferably in quantities of 1 to 3% by weight, based on the alkyl and/or alkenyl oligoglycosides. It has proved to be of advantage in this regard to use the iron(III) ions in quantities of 0.01 to 0.5% by weight in order reliably to prevent discoloration of the products catalyzed by Fe ions.

The process according to the invention is of course used to stabilize aqueous preparations containing alkyl and/or alkenyl oligoglycosides. The solids content of these preparations may be from 1 to 70% by weight and preferably from 30 to 60% by weight, the problem of reduced stability in storage caused by crystallization only acquiring real significance in the case of more highly concentrated products. In the context of the process according to the invention, the aqueous preparations may also contain other ingredients typical of laundry detergents, dishwashing detergents and cleaning products such as, for example, anionic, nonionic, amphoteric or zwitterionic surfactants, oil components, builders, hydrotropes, fillers, optical brighteners, redeposition inhibitors, foam inhibitors and fragrances.

Commercial Applications

The aqueous preparations containing alkyl and/or alkenyl oligoglycosides obtainable by the process according to the invention are color-stable at storage temperatures of around 30° C. and show hardly any tendency towards crystallization. At the same time, the solubility limit is reduced. Accordingly, they are suitable for the production of laundry detergents, dishwashing detergents and cleaning products and also hair-care and personal hygiene products, in which they may be present in quantities of 1 to 50% by weight and preferably 10 to 30% by weight, based on the particular product.

The following Examples are intended to illustrate the invention without limiting it in any way.

EXAMPLES

I. Substances used

A) $C_{12/14}$ cocoalkyl oligoglucoside (DP=1.3) Plantaren® APG 600, a product of Henkel KGaA, Düsseldorf, FRG B1) 2-Ethylhexyl oligoglucoside B2) 2-Hexyldecyl oligoglucoside B3) Decyl alcohol B4) Lauryl alcohol B5) Myristyl alcohol B6) $C_{12/14}$ cocofatty alcohol 7 EO adduct B7) Polyethylene glycol, molecular weight 600

B8) Glucose

B9) Fe(III) ions used as $FeCl_3$

II. Preparation of the samples

A paste of 500 g of $C_{12/14}$ cocoalkyl oligoglucoside A (solids content 52% by weight) was heated with and without crystallization moderators until a clear solution was obtained. The clear solution obtained was then stored first for 7 days at 6° C. and then for 6 weeks at room temperature. End melting points (EMP) for hydrates of the cocoalkyl oligoglucoside containing 1 to 4 moles of water of crystallization, which were successively passed, were determined by differential thermoanalysis as a function of the storage time.

The end melting points for the hydrates with the highest EMP are shown in Table 1. The results are intended to be interpreted to mean that no crystallization occurs where the cocoalkyl oligoglucoside is stored above the EMP shown and that only greatly delayed crystallization occurs where it is stored below the EMP shown.

TABLE 1

| | DSC measurements | | |
|---|---|---|---|
| Ex. | CM | c(CM) % | EMP °C. |
| 1 | B1 | 1.00 | 30 |
| 2 | B2 | 1.00 | 30 |
| 3 | B2 | 5.00 | 29 |
| 4 | B3 | 5.00 | 28 |
| 5 | B3 | 7.00 | 27 |
| 6 | B4 | 3.00 | 29 |
| 7 | B5 | 3.00 | 31 |
| 8 | B5 | 5.00 | 30 |
| 9 | B6 | 5.00 | 29 |
| 10 | B7 | 1.00 | 30 |
| 11 | B8 | 1.00 | 29 |
| 12 | B9 | 0.01 | 30 |
| C1 | — | — | >40 |

Legend:
Cm = Crystallization moderator
c(CM) = Concentration of crystallization moderator

What is claimed is:

1. A process for the production of an aqueous storable nonionic surfactant which comprises adding from about 0.01 to about 0.5% by weight of an iron (III) ion to an aqueous medium containing an alkyl glycoside or alkenyl glycoside of the formula (I):

$$R^1O—(G)_p \quad (I)$$

wherein $R^1$ is a linear alkyl or alkenyl radical having from 6 to 22 carbon atoms, G is a sugar unit containing 5 or 6 carbon atoms, and p is a number of from 1 to 10.

2. The process of claim 1 wherein the solids content of the aqueous nonionic surfactant is in the range of from about 1 to about 70% by weight.

3. The process of claim 2 wherein said solids content is from about 30 to about 60% by weight.

* * * * *